US011795794B2

(12) United States Patent
Williams

(10) Patent No.: US 11,795,794 B2
(45) **Date of Patent: *Oct. 24, 2023**

(54) GAS-LIFT SYSTEM WITH PAIRED CONTROLLERS

(71) Applicant: Epic Lift Systems LLC, Fort Worth, TX (US)

(72) Inventor: Jason Williams, Fort Worth, TX (US)

(73) Assignee: Epic Lift Systems LLC, Fort Worth, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/521,520

(22) Filed: Nov. 8, 2021

(65) Prior Publication Data

US 2022/0065092 A1 Mar. 3, 2022

Related U.S. Application Data

(63) Continuation of application No. 16/011,071, filed on Jun. 18, 2018, now Pat. No. 11,199,081.

(51) Int. Cl.

| | |
|---|---|
| ***E21B 34/06*** | (2006.01) |
| ***E21B 43/12*** | (2006.01) |
| ***E21B 43/40*** | (2006.01) |
| ***F04B 47/02*** | (2006.01) |
| ***F04B 47/12*** | (2006.01) |
| ***F04B 49/06*** | (2006.01) |

(Continued)

(52) U.S. Cl.

CPC ..... *E21B 43/122* (2013.01); *E21B 34/066* (2013.01); *E21B 43/40* (2013.01); *F04B 9/1273* (2013.01); *F04B 47/02* (2013.01); *F04B 47/12* (2013.01); *F04B 49/065* (2013.01); *F04B 53/12* (2013.01); *F04B 2201/0201* (2013.01); *F04B 2207/043* (2013.01)

(58) Field of Classification Search

CPC ..... E21B 33/066; E21B 43/122; E21B 43/40; F04B 47/12; F04B 2201/0201; F04B 2207/043; F04B 47/02; F04B 49/065; F04B 53/12; F04B 9/1273

See application file for complete search history.

(56) References Cited

U.S. PATENT DOCUMENTS

| | | | |
|---|---|---|---|
| 1,993,292 | A | 3/1935 | Woods |
| 3,090,316 | A | 5/1963 | Montgomery |

(Continued)

OTHER PUBLICATIONS

Shuyler Kuykendall, "Recycle Loop for a Gas Lift Plunger", U.S. Appl. No. 15/367,389, filed Dec. 2, 2016.

*Primary Examiner* — Daniel P Stephenson

(74) *Attorney, Agent, or Firm* — Park, Vaughan, Fleming & Dowler LLP

(57) ABSTRACT

Systems and methods for controlling operation of a well, of which the method includes receiving an operation setting for operation of a system that provides lift gas into and produces gas from the well, monitoring operation of the system using a first controller, determining, using the first controller, that the system is not operating at the operation setting, and in response to determining that the system is not operating at the operation setting, sending, using a two-way communication link from the first controller to a second controller, a control signal to the second controller. The control signal is configured to cause the second controller to modify an operation of a compressor of the system.

22 Claims, 4 Drawing Sheets

(51) Int. Cl.
*F04B 53/12* (2006.01)
*F04B 9/127* (2006.01)

(56) References Cited

U.S. PATENT DOCUMENTS

| | | | | | |
|---|---|---|---|---|---|
| 3,548,939 | A | * | 12/1970 | Bennett | E21B 43/122 166/267 |
| 4,211,279 | A | | 7/1980 | Isaacks | |
| 4,685,522 | A | * | 8/1987 | Dixon | E21B 43/12 166/263 |
| 5,735,346 | A | | 4/1998 | Brewer | |
| 5,875,858 | A | | 3/1999 | Brady | |
| 6,516,879 | B1 | | 2/2003 | Hershberger | |
| 9,429,000 | B1 | | 8/2016 | Velasquez et al. | |
| 10,544,659 | B2 | * | 1/2020 | Kuykendall | F04B 47/12 |
| 10,544,660 | B2 | * | 1/2020 | Kuykendall | E21B 43/123 |
| 11,199,081 | B2 | * | 12/2021 | Williams | F04B 49/065 |
| 2002/0074118 | A1 | | 6/2002 | Fisher | |
| 2003/0121656 | A1 | | 7/2003 | Hershberger | |
| 2003/0145991 | A1 | | 8/2003 | Olsen | |
| 2004/0244991 | A1 | | 12/2004 | Reitz | |
| 2007/0039739 | A1 | | 2/2007 | Wilson | |
| 2008/0185141 | A1 | | 8/2008 | Amies et al. | |
| 2013/0037147 | A1 | * | 2/2013 | Jones | F23N 1/007 137/625.47 |
| 2017/0159412 | A1 | * | 6/2017 | Kuykendall | E21B 43/122 |
| 2017/0343986 | A1 | * | 11/2017 | Zhang | E21B 43/122 |
| 2018/0320684 | A1 | * | 11/2018 | Rosca | F04B 49/20 |
| 2018/0363442 | A1 | * | 12/2018 | Williams | F04B 47/02 |
| 2020/0072220 | A1 | * | 3/2020 | Moens | F04C 28/08 |
| 2022/0065092 | A1 | * | 3/2022 | Williams | E21B 34/066 |

* cited by examiner

GAS-LIFT SYSTEM WITH PAIRED CONTROLLERS

CROSS-REFERENCE TO RELATED APPLICATIONS

This application is a continuation of application Ser. No. 16/011,071 filed Jun. 18, 2018, now U.S. Pat. No. 11,199,081, which claims priority to U.S. Provisional Application No. 62/522,362 filed on Jun. 20, 2017, the entirety of which is hereby incorporated by reference.

BACKGROUND

Gas lift plungers are employed to facilitate the removal of gas from wells, addressing challenges incurred by "liquid loading." In general, a well may produce both liquid and gaseous elements. When gas flow rates are high, the gas carries the liquid out of the well as the gas rises. However, as the pressure in the well decreases, the flowrate of the gas decreases to a point below which the gas fails to carry the heavier liquids to the surface. The liquids thus fall back to the bottom of the well, exerting back pressure on the formation, and thereby loading the well.

Plungers alleviate such loading by assisting in removing liquid and gas from the well, e.g., in situations where the ratio of liquid to gas is high. For example, the plunger is introduced into the top of the well. One type of plunger includes a bypass valve that is initially in an open position. When the bypass valve is in the open position, the plunger descends through a tubing string in the well toward the bottom of the well. Once the plunger reaches the bottom of the well, the bypass valve is closed. A compressed gas is then introduced into the well, below the plunger. The compressed gas lifts the plunger within the tubing string, causing any liquids above the plunger to be raised to the surface.

A compressor at the surface pressurizes the gas that is introduced into the well. As will be appreciated, the operation of the plunger is more efficient when the compressed gas is not introduced into the well as the plunger is descending. However, releasing the compressed gas into the atmosphere as the plunger descends generates a loud noise that may be harmful to the ears of those around. In addition, releasing the compressed gas into the atmosphere may also raise environmental concerns. Another option would be to turn the compressor off every time the plunger is descending; however, frequent switching of the compressor on and off may be inefficient and may reduce the lifespan of the compressor.

Furthermore, in some cases, the operation of the compressor may need to be adjusted to maintain efficient production. For example, the flowrate of the compressed gas may eventually become too low for the well conditions. In such case, the cycle time for the plunger may become too long, and thus a higher gas flowrate may be called for. Typically, this involves manual reconfiguration of the compressor.

SUMMARY

Embodiments of the disclosure may provide a method for controlling operation of a well, of which the method includes receiving an operation setting for operation of a system that provides lift gas into and produces gas from the well, monitoring operation of the system using a first controller, determining, using the first controller, that the system is not operating at the operation setting, and in response to determining that the system is not operating at the operation setting, sending, using a two-way communication link from the first controller to a second controller, a control signal to the second controller. The control signal is configured to cause the second controller to modify an operation of a compressor of the system.

Embodiments of the disclosure may also provide a system including a compressor configured to compress gas, a compressor controller configured to control an operation of the compressor, a wellhead configured to receive compressed gas from the compressor, a wellhead controller coupled to the wellhead and configured to measure one or more operation settings, and a two-way communication link between the wellhead controller and the compressor controller. The wellhead controller is configured to send one or more control signals to the compressor controller via the two-way communication link, and the compressor controller is configured to adjust the operation of the compressor in response to the one or more control signals.

Embodiments of the disclosure may also provide a method for controlling operation of a well. The method includes introducing a gas into a separator. The method also includes removing particles from the gas using the separator to produce a clean gas. The method also includes introducing the clean gas into a compressor. The method also includes determining when a plunger is at a predetermined position in the well. The method also includes transmitting a first signal to a controller when the plunger is at the predetermined position in the well. The method also includes causing the compressor to not compress the clean gas flowing therethrough in response to the first signal. The method also includes actuating a valve into a first position in response to the first signal, thereby allowing the plunger to descend in the well. The method also includes transmitting a second signal to the controller a predetermined amount of time after the plunger is determined to be at the predetermined position in the well. The method also includes compressing the clean gas using the compressor in response to the second signal. The method also includes actuating the valve into a second position in response to the second signal, thereby causing the plunger to ascend in the well.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

Figure 1:
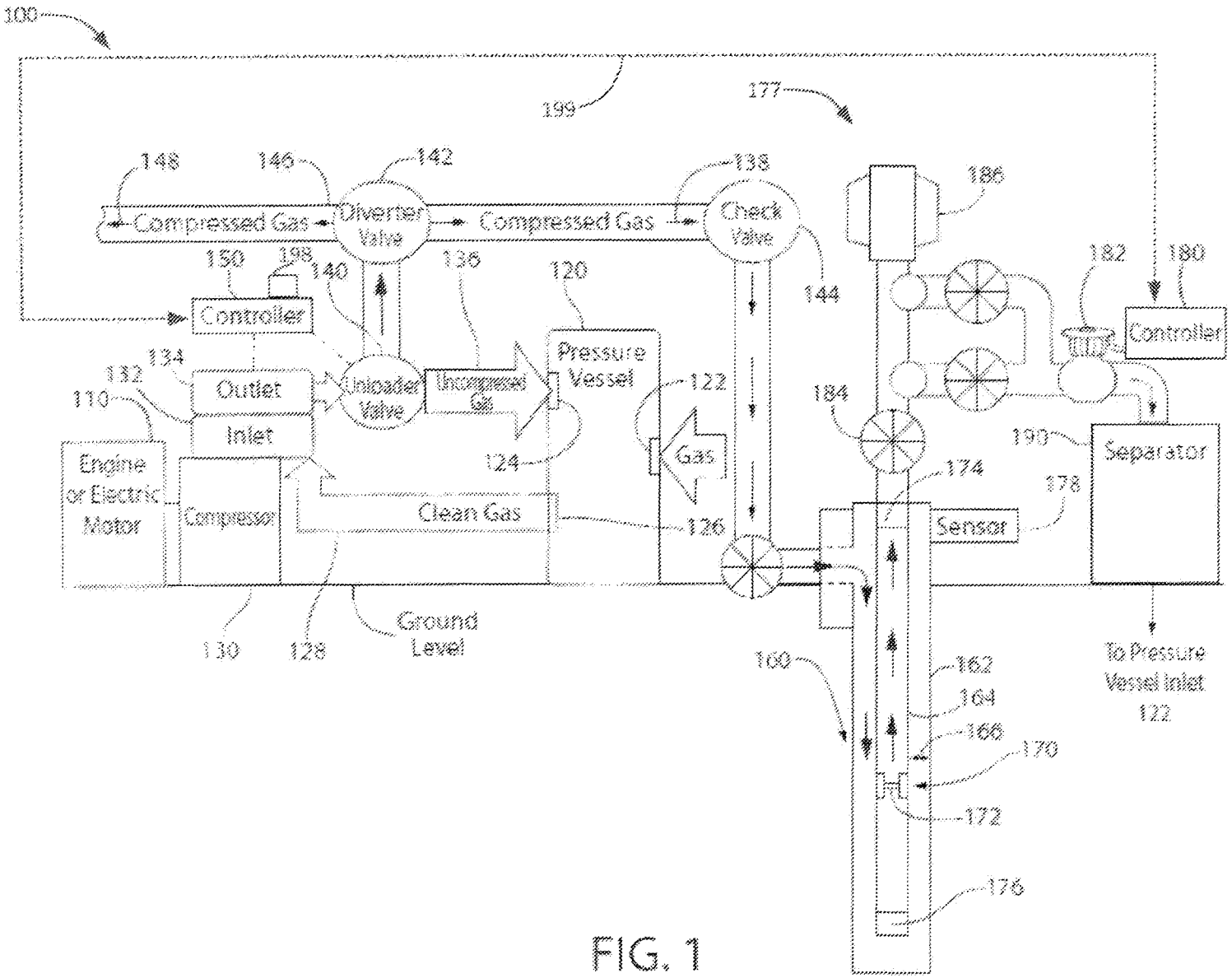
FIG. 1 illustrates a schematic view of a system for operating a gas-lift plunger in a well, according to an embodiment.

it should be noted that some details of the figure have been simplified and are drawn to facilitate understanding of the embodiments rather than to maintain strict structural accuracy, detail, and scale.

DETAILED DESCRIPTION

In general, embodiments of the present disclosure may provide a gas-lift well production system, and method for operating such system, which may include paired controllers, optionally with remote configuration access. The system may generally include a compressor, with a compressor controller, and a wellhead (i.e., equipment positioned at the top of a well), with a wellhead controller. The wellhead controller and the compressor controller may be in two-way communication with one another such that they are able send control and/or status signals therebetween. The wellhead controller may determine when one or more system operating characteristics are suboptimal (e.g., plunger cycle time is too long). In response, the wellhead controller may communicate a signal indicative of this determination to the compressor controller.

The compressor controller may, in response, modulate the compressor's operating parameters (e.g., speed and/or suction pressure) and/or any other system parameters (e.g., diverter valve position) to adjust the flowrate of injection gas to the well. The compressor controller and/or the wellhead controller may be configured to provide acknowledgment signals in response to receiving a signal from the other controller, and/or may provide status update signals (e.g., a "heartbeat"), such that both controllers are "aware" that the other controller is online and can ascertain and take mitigating steps (e.g., initiate alarms, shutdown, etc.) when the other controller goes offline. This and other various aspects of the present disclosure may be accomplished in a variety of different ways, a few examples of which are provided below.

In some embodiments, such systems with paired controllers may be able to change the state of the compressor (e.g., speed and/or suction pressure) This may reduce wear on the machine, save fuel, and eliminate or at least reduce consumption of purchase gas (gas sent to and then bought back from the well owner). Further, such systems may be implemented in gas-lift wells and in plunger-lift wells.

Reference will now be made in detail to embodiments of the present teachings, examples of which are illustrated in the accompanying drawing. In the drawings, like reference numerals have been used throughout to designate identical elements, where convenient. In the following description, reference is made to the accompanying drawing that forms a part thereof, and in which is shown by way of illustration one or more specific example embodiments in which the present teachings may be practiced.

Further, notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

FIG. 1 illustrates a schematic view of a system 100 for operating a gas-lift plunger 170 in a well 160, according to an embodiment. Although illustrated as a plunger-lift system, it will be appreciated that the present system 100 may be employed in a gas-lift application. The system 100 may include a driver 110, such as an internal combustion engine or electric motor, a pressure vessel 120, and a compressor 130. When active, the driver 110 drives the compressor 130, such that the compressor 130 is capable of compressing gas.

The pressure vessel 120 may be a separator (e.g., a scrubber). The pressure vessel 120 may have one or more inlets (two are shown: 122, 124) and one or more outlets (one is shown: 126). The pressure vessel 120 may be configured to receive a gas through the first inlet 122, the second inlet 124, or both inlets 122, 124. Although not shown, in at least one embodiment, the pressure vessel 120 may include a single inlet, and the two inlet flows may both enter the pressure vessel 120 through the single inlet (e.g., via a T-coupling coupled to the single inlet). The pressure vessel 120 may then separate (i.e., remove) particles from the gas to clean the gas. In at least one embodiment, the pressure vessel 120 may be a gravity-based separator, such that the separation may be passive, allowing the denser solid particles to fall to the bottom of the pressure vessel 120. The clean gas may then exit the pressure vessel 120 through the outlet 126. The pressure vessel 120 may have an internal volume ranging from about 0.04 $m^3$ to about 0.56 $m^3$, or more.

The compressor 130 may include an inlet 132 that is coupled to and in fluid communication with the outlet 126 of the pressure vessel 120. The gas that flows out of the outlet 126 of the pressure vessel 120 may be introduced into the inlet 132 of the compressor 130, as shown by arrows 128. The compressor 130 may be configured to compress the gas received through the inlet 132. The gas may exit the compressor 130 through an outlet 134 of the compressor 130. The compressor 130 may be a reciprocating compressor. In other embodiments, the compressor 130 may be a centrifugal compressor, a diagonal or mixed-flow compressor, an axial-flow compressor, a rotary screw compressor, a rotary vane compressor, a scroll compressor, or the like.

A first valve (also referred to as an "unloader valve") 140 may be coupled to and in fluid communication with the outlet 134 of the compressor 130. When the first valve 140 is in a first position, the gas may flow through the first valve 140 and be introduced back into the pressure vessel 120, as shown by arrows 136. For example, the gas may be introduced into the pressure vessel 120 through the second inlet 124. When the first valve 140 is in a second position, the gas exiting the compressor 130 may flow through the first valve 140 and be introduced into a well 160 (as shown by arrows 138) and/or a sales line 146 (as shown by arrows 148). As used herein, a "sales line" refers to a pipeline where the gas is metered and sold.

A second valve (also referred to as a "diverter valve") 142 may be coupled to and in fluid communication with the outlet 134 of the compressor 130 and/or the first valve 140. As shown, the second valve 142 may be positioned downstream from the first valve 140. When the second valve 142 is in a first position (e.g., "open"), the gas from the compressor 130 may flow through the second valve 142 and be introduced into the sales line 146, as shown by arrows 148. The gas may not flow into the well 160 when the second valve 142 is in the first position. When the second valve 142 is in a second position (e.g., "closed" or "shut"), the gas from the compressor 130 may flow through the second valve 142 and be introduced into the well 160, as shown by arrows 138. The gas may not flow into the sales line 146 when the second valve 142 is in the second position.

A third valve 144 may be coupled to and in fluid communication with the second valve 142. The third valve 144 may be positioned between the second valve 142 and the well 160 (i.e., downstream from the second valve 142). The third valve 144 may be a check valve or a diverter valve that allows the gas to flow through in one direction but not in the opposing direction. For example, the third valve 144 may allow the gas to flow from the compressor 130 into the well 160, but not from the well 160 into the sales line 146. Optionally, another check (or diverter) valve may be positioned between the first valve 140 and the second valve 142, so as to prevent backflow of gas into the first valve 140.

A compressor controller 150 may be coupled to the compressor 130, the first valve 140, the second valve 142, or a combination thereof. The compressor controller 150 may be configured, among other things, to control one or more operating parameters of the compressor 130. For example, the compressor controller 150 may be configured to adjust the speed (or RPM—revolutions per minute) of the compressor 130. Control of the speed of the compressor 130 may be accomplished in a variety of ways, e.g., by communication with the driver 110, power source, and/or driveline components between the driver 110 and the compressor 130.

Additionally or alternatively, the compressor controller 150 may be configured to adjust the suction pressure of the compressor 150. For example, adjustment of the suction pressure may be achieved by selectively opening and closing two or more pilot valves at the inlet 132. For example, if two pilot valves are provided, one may operate at (e.g., "correspond to") a relatively high suction pressure, while the other may operate at (e.g., "correspond to") a relatively low suction pressure. Thus, the suction pressure of the compressor 130 may be determined by which of the pilot valve is open and which is closed. In some embodiments, more than two such inlet valves may be provided, thereby allowing for more than two choices of suction pressures. In other embodiments, one or more such inlet valves may be provided with a variable position, which may allow for many different setpoints (sometimes referred to as "infinite" control) for the suction pressure.

Further, as also discussed in greater detail below, the compressor controller 150 may be configured to actuate the first (unloader) valve 140 between its first and second positions. The compressor controller 150 may also be configured to actuate the second (diverter) valve 142 between its first and second positions. In addition, the compressor controller 150 may be configured to cause the compressor 130 to not compress the gas during predetermined intervals. In other words, the gas flowing out through the outlet 134 of the compressor 130 may have substantially the same pressure as the gas flowing in through the inlet 132 of the compressor 130 during such intervals. In one embodiment, the compressor 130 may not compress the gas when the first valve 140 is in the first position, and the compressor 130 may compress the gas when the first valve 140 is in the second position.

Referring back to the well 160, a casing 162 may be coupled to the wall of the well 160 by a layer of cement. A tubing string (e.g., a production string) 164 may be positioned radially-inward from the casing 162. An annulus 166 may be defined between the casing 162 and the tubing string 164. A plunger 170 may be moveable within the tubing suing 164. In some embodiments, a substantially fluid-tight seal may be formed between the outer surface of the plunger 170 and the inner surface of the tubing string 164. Optionally, a bore may be formed axially-through the plunger 170, and a valve 172 may be positioned within the bore. The valve 172 may be opened when the plunger 170 contacts a first actuator (e.g., "bumper spring") 174 proximate to the upper end of the tubing suing 164. The valve 172 may be closed when the plunger 170 contacts a second actuator (e.g., "bumper spring") 176 proximate to the lower end of the tubing string 164. In another embodiment, the plunger 170 may be a pad-type plunger.

The plunger 170 may cycle from the bottom of the well 160, to the top of the well 160, back to the bottom of the well 160, and so on. More particularly, when the valve 172 in the plunger 170 is in the closed position and the well 160 is producing enough gas to lift the liquid, the gas may lift the plunger 170, and the liquid that is above the plunger 170 in the tubing string 164, to the surface (e.g., when an outlet valve is opened at the surface). As discussed in more detail below, when the well 160 is not producing enough gas to lift the liquid to the surface, or the well 160 is not producing enough gas to lift the liquid to the surface within a predetermined amount of time, additional compressed gas (e.g., from the compressor 130) may be introduced into the well 160 to lift the plunger 170 and the liquid. When the plunger 170 reaches the surface and contacts the first actuator 174, the valve 172 in the plunger 170 may open, which may allow the plunger 170 to descend toward the bottom of the well 160.

When the plunger 170 reaches the bottom of the well 160 and contacts the second actuator 176, the valve 172 in the plunger 170 may close. Then, the gas produced in the well 160, the compressed gas introduced into the well 160, or a combination thereof may lift the plunger 170, and the liquid that is above the plunger 170 in the tubing string 164, back to the surface. The plunger 170 may continue to cycle up and down, lifting liquid to the surface with each trip.

The system 100 may also include wellhead equipment 177 positioned at the topside surface of the well 170. The wellhead equipment 177 may include a sensor 178 positioned proximate to the top of the well 160 (e.g., at or near the surface). The sensor 178 may be coupled to the tubing string 164, the first actuator 174, a lubricator 186 (introduced below), or other equipment at the surface. The sensor 178 may detect or sense each time the plunger 170 reaches the surface. In one embodiment, the sensor 178 may detect or sense when the plunger 170 is within a predetermined distance from the sensor 178. In another embodiment, the sensor 178 may detect or sense when the plunger 170 contacts the first actuator 174 and/or the lubricator 186.

In yet another embodiment, the sensor 178 may be a pressure transducer that is coupled to and/or in fluid communication with the tubing string 164, the first actuator 174, the lubricator 186, the inlet 132 of the compressor 130, the outlet 134 of the compressor 130, or the like. It may be determined that the plunger 170 is at a predetermined position in the well 160 when the pressure measured by the pressure transducer is greater than or less than a predetermined amount. For example, a user may open or close a valve (e.g., valve 182, 184) to cause the plunger 170 to ascend or descend within the well 160. The opening or closing of the valve (e.g., 182, 184) may cause the pressure to increase or decrease beyond the predetermined amount, which may be detected by the sensor 178.

In some embodiments, the system 100 may also include a wellhead controller 180. The wellhead controller 180 may receive the data from the sensor 178 and communicate with the compressor controller 150 in response to the data from the sensor 178, as discussed in greater detail below. In some embodiments, the wellhead controller 180 may track the cycle time, i.e., the time the plunger 170 takes to complete a lifting cycle in the well 160, e.g., the time the plunger 170 takes to descend from and rise back to a position proximal to the first actuator 174 and/or the lubricator 186.

The system 100 may also include a control valve 182 and a master valve 184. The wellhead controller 180 may close and open the control valve 182 depending on the point in the cycle to shut-in the well 160 or allow the well 160 to produce. The lubricator 186 may be positioned above the master valve 184. The lubricator 186 houses a shift rod and shock absorber to actuate the plunger 170 at the surface.

Although shown as different components, in another embodiment, the first actuator 174 and the lubricator 186 may be the same component.

In some embodiments, the system 100 may also include a separator 190. The separator 190 may be configured to receive gas from the well 160. The separator 190 may separate (i.e., remove) particles from the gas to clean the gas. In at least one embodiment, the separator 190 may be a gravity-based separator, such that the separation may be passive, allowing the denser solid particles to fall to the bottom of the separator 190. The outlet of the separator 190 may be in fluid communication with the inlet 122 of the pressure vessel 120 and/or the inlet 132 of the compressor 130.

As mentioned above, the compressor controller 150 and the wellhead controller 180 may be in communication with one another. In some embodiments, the controllers 150, 180 may communicate generally continuously, in order to provide a status update to the other, e.g., indicating to the other that the controller 150, 180 is online and able to function. The controllers 150, 180 may also be able to pass control signals therebetween. As such, a two-way communication link 199 may be provided between the controllers 150, 180. In some situations, this two-way link 199 may be representative of a wired or wireless communication link. For example, the link may employ a wireless standard such as BLUETOOTH*. The link may be via radiofrequency, infrared, acoustic, optical, or any other transmission (e.g., telemetry) medium. The signals transmitted between the controllers 150, 180 may range from relatively simple (e.g., a binary off/on signal) to more complex (numbers, status, values for operating parameters, etc.), and the transmission link therebetween may be selected to provide efficient transmission of the given complexity of signals within a suitable amount of time. The link 199 may include one or more devices, such as repeaters, amplifiers, conditioners, antennae, etc.

The provision of the link 199 may also enable or at least facilitate remote access to either or both of the controllers 150, 180. For example, a modem 198 that is capable of communicating with an external device (e.g., computer at a remote terminal) may be provided on the compressor 130 and in communication with the compressor controller 150, or vice versa. Thus, a user may remotely access the compressor controller 150 and then communicate with the wellhead controller 180 via the two-way link 199. This may avoid a requirement for a powered modem to be placed at the wellhead controller 180, since power consumption may be at a premium at this position. In other embodiments, however, a modem may be provided at the wellhead controller 180 and not at the compressor 130, so as to allow for communication from an external device to the compressor controller 150 via the wellhead controller 180 and the two-way link 199. In still other embodiments, a modem may be provided at both the compressor 130 and the wellhead controller 180, so as to, along with the two-way link 199, provide for redundancy in communication.

Figure 2:
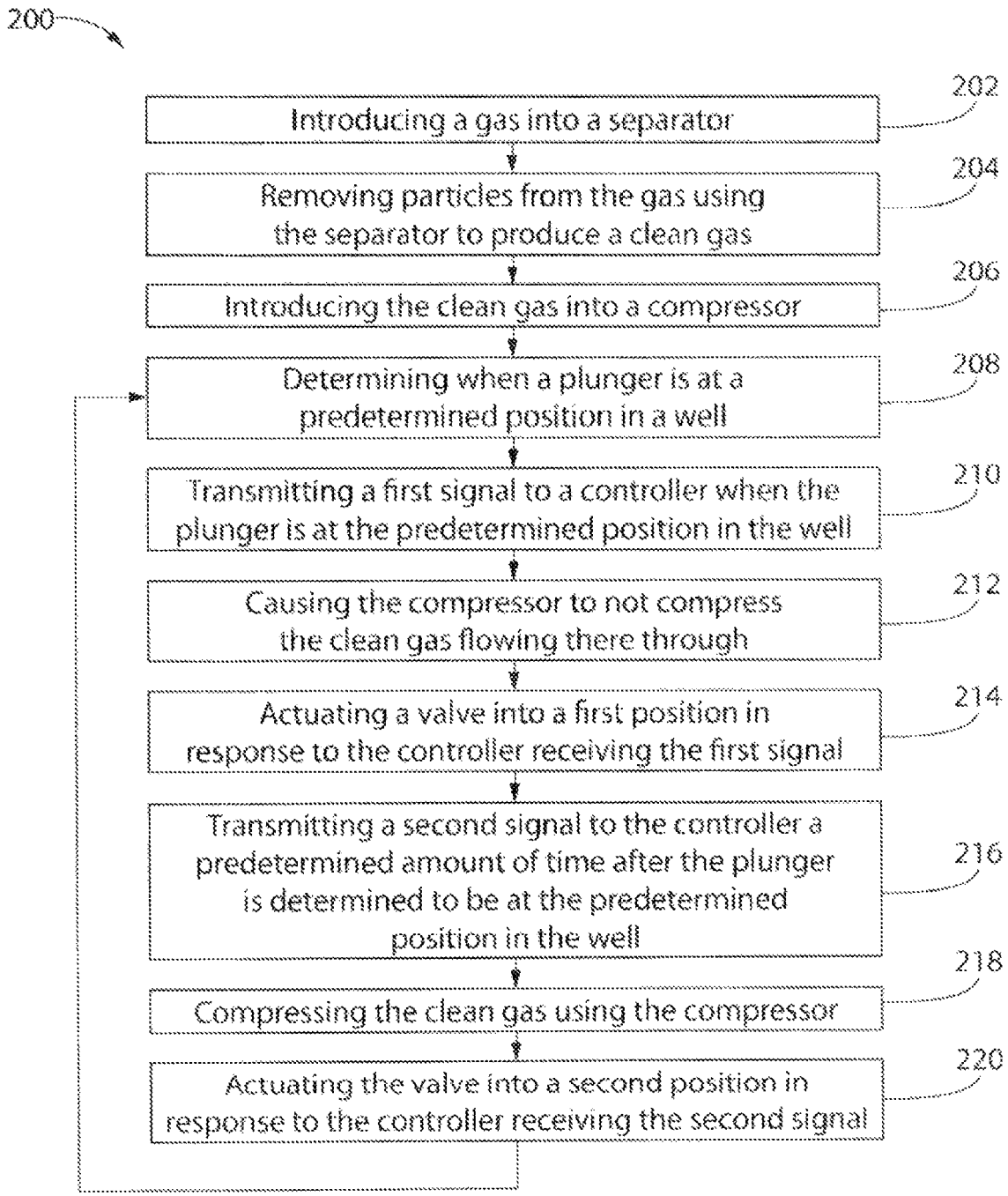
FIG. 2 illustrates a flowchart of a method for operating the gas-lift plunger in the well, according to an embodiment.

FIG. 2 illustrates a flowchart of a method 200 for operating the gas-lift plunger 170 in the well 160, according to an embodiment. The method 200 is described herein with reference to the system 100 in FIG. 1 as a matter of convenience, but may be employed with other systems. The method 200 may begin by introducing a gas into the pressure vessel 120, as at 202. The gas may be any mixture of natural gases. As described above, the gas may be introduced into the pressure vessel 120 through the first inlet 122 of the pressure vessel 120. The method 200 may then include removing particles from the gas using the pressure vessel 120 to produce a clean gas, as at 204. The method 200 may then include introducing the clean gas into the compressor 130, as at 206.

The method 200 may also include determining, using the sensor 178, when the plunger 170 is at a predetermined position in the well 160, as at 208. In one embodiment, the predetermined position may be proximate to the top of the well 160. In another embodiment, the predetermined position may be when the plunger 170 contacts the first actuator 174 and/or the lubricator 186.

The sensor 178 may transmit a signal to the wellhead controller 180 each time the sensor 178 detects the plunger 170. The method 200 may include transmitting a first signal from the wellhead controller 180 to the compressor controller 150 when the plunger 170 is at the predetermined position, as at 210. The first signal may be transmitted through a cable or wire, or the first signal may be transmitted wirelessly. In the embodiment where the sensor 178 is a pressure transducer, the wellhead controller 180 may be omitted, and the sensor 178 may send a signal directly to the compressor controller 150 when the measured pressure is greater than or less than the predetermined amount.

In response to receiving the first signal from the wellhead controller 180 (or the signal from the sensor 178), the compressor controller 150 may cause the compressor 130 to not compress the gas flowing therethrough (i.e., "unload" the compressor 130 to provide an uncompressed gas), as at 212. In some embodiments, the uncompressed gas may still have a pressure greater than atmospheric pressure. The uncompressed gas may, however, have a lower pressure than the compressed gas (e.g., at 218 below). In response to receiving the first signal, the compressor controller 150 may also actuate the first valve 140 at the outlet 134 of the compressor 130 into the first position, as at 214, such that the uncompressed gas that exits the compressor 130 flows back into the pressure vessel 120.

When the first valve 140 at the outlet 134 of the compressor 130 is in the first position, and the valve 172 in the plunger 170 is open (e.g., after contacting the first actuator 174), the plunger 170 may begin descending back to the bottom of the well 160. The uncompressed gas may continue to flow into the pressure vessel 120 as the plunger 170 descends. The uncompressed gas may only flow into the pressure vessel 120 up to the set suction pressure. The set suction pressure may be from about 15 psi to about 100 psi or more. The pressure vessel 120 may be certified for pressures ranging from about 100 psi to about 400 psi, about 400 psi to about 800 psi, about 800 psi to about 1200 psi, or more. The volume of the pressure vessel 120 (provided above) may be large enough to store the gas introduced front the compressor 130 while the plunger 170 descends in the well 160.

The method 200 may also include transmitting a second signal from the wellhead controller 180 to the compressor controller 150 a predetermined amount of time after the plunger 170 is determined to be at the predetermined position in the well 160, as at 216. The second signal may be transmitted through a cable or wire, or the second signal may be transmitted wirelessly. In another embodiment, the compressor controller 150 may have a timer set to the predetermined amount of time so that the second signal from the wellhead controller 180 may be omitted. The predetermined amount of time may be the time (or slightly more than the amount of time) that it takes for the plunger 170 to descend back to the bottom of the well 160 (e.g., to contact the second actuator 176), which may be known or estimated.

For example, the density of the plunger 170, the density of the fluids in the well 160, and the distance between the first and second actuators 174, 176 may all be known or estimated. This may enable a user to calculate or estimate the time for the plunger 170 to descend to the bottom of the well 160.

In response to receiving the second signal, the compressor controller 150 may cause the compressor 130 to compress the clean gas from the pressure vessel 120 to provide a compressed gas, as at 218. In response to receiving the second signal, the compressor controller 150 may also actuate the first valve 140 at the outlet 134 of the compressor 130 into the second position, as at 220, such that the compressed gas that exits the compressor 130 flows into the well 160, as shown by arrows 138 in FIG. 1. In another embodiment, the compressor controller 150 may automatically perform steps 218 and 220 after the predetermined amount of time, and the second signal may be omitted.

When the first valve 140 is in the second position, the compressed gas may flow from the compressor 130, through the first valve 140, and into the annulus 166 in the well 160. The compressed gas may then flow down through the annulus 166 and into the tubing string 164 at a position below the plunger 170 and/or the second actuator 176. The compressed gas may then flow up through the tubing string 164, which may lift the plunger 170 back toward the surface. The method 200 may then loop back around to step 208. In another embodiment, an injection valve may be attached to the tubing string 164 at a location below the plunger 170 and/or the second actuator 176. The compressed gas may be injected through the injection valve and into the tubing string 164.

In yet another embodiment, the compressor 130 may pull (e.g., suck) on the tubing string 164. More particularly, gas at the upper end of the tubing string 164 may be introduced into the inlet 132 of the compressor 130. This may exert a force inside the tubing string 164 that pulls the plunger 170 upward. The outlet 134 of the compressor 130 may introduce the compressed gas into the annulus 166, as described above, or a portion of the compressed gas may be introduced into a sales line.

As will be appreciated, the system 100 and method 200 may control the injection of gas from the compressor 130 on demand by "unloading" the compressor 130 (e.g., as at 212 and/or 214) and "loading" the compressor 130 (e.g., as at 218 and/or 220) in response to the detection by the sensor 178, the predetermined amount of time, or a combination thereof. The system 100 and method 200 may also stop the compressor 130 before the compressor 130 runs out of sufficient gas to restart. By redirecting the gas to the pressure vessel 120 (i.e., unloading the compressor 130), the compressor 130 may avoid blowing down and/or emitting gas to the atmosphere. This is accomplished by unloading the compressor 130 back into the pressure vessel 120 and unloading the compressor 130 so that it may restart without any emission of gas to the atmosphere. In addition, by introducing the gas from the compressor 130 back into the pressure vessel 120, rather than releasing the gas into the atmosphere, the loud noise generated by the release of the compressed gas may be avoided. The environmental concerns caused by releasing the compressed gas into the atmosphere may also be alleviated.

Figure 3:
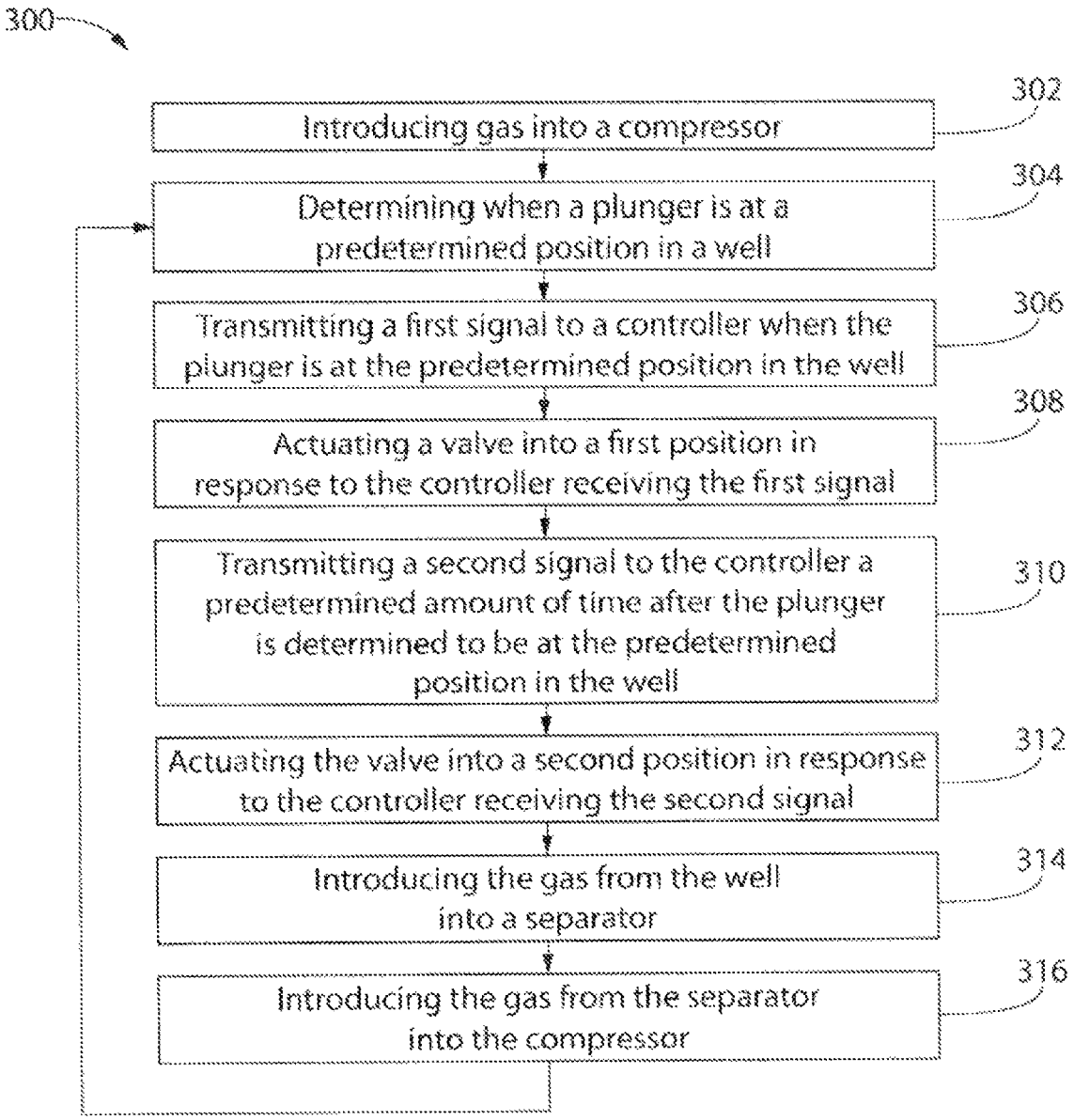
FIG. 3 illustrates a flowchart of another method for operating the gas-lift plunger in the well, according to an embodiment.

FIG. 3 illustrates a flowchart of another method 300 for operating the gas-lift plunger 170 in the well 160, according to an embodiment. The method 300 is described herein with reference to the system 100 in FIG. 1 as a matter of convenience, but may be employed with other systems. The method 300 may begin by introducing a gas into the compressor 130, as at 302. The gas may come from the pressure vessel 120 or the separator 190 (see FIG. 1).

The method 300 may also include determining, using the sensor 178, when the plunger 170 is at a predetermined position in the well 160, as at 304. In one embodiment, the predetermined position may be proximate to the top of the well 160. In another embodiment, the predetermined position may be when the plunger 170 contacts the first actuator 174 and/or the lubricator 186, after which time, the valve 172 is open, and the plunger 170 begins descending.

The sensor 178 may transmit a signal to the wellhead controller 180 each time the sensor 178 detects the plunger 170. The method 300 may include transmitting a first signal from the wellhead controller 180 to the compressor controller 150, e.g., via the link 199, when the plunger 170 is at the predetermined position, as at 306. The first signal may be transmitted through a cable or wire, or the first signal may be transmitted wirelessly. In the embodiment where the sensor 178 is a pressure transducer, the wellhead controller 180 may be omitted, and the sensor 178 may send a signal directly to the compressor controller 150 when the measured pressure is greater than or less than the predetermined amount.

In response to receiving the first signal from the wellhead controller 180 (or the signal from the sensor 178), the compressor controller 150 may actuate the second valve 142 into (or maintain the second valve 142 in) the first position, as at 308. When in the first position, the gas from the compressor is directed into the sales line 146. The third valve 144 prevents the gas in the well 160 from flowing into the sales line 146.

When the second valve 142 is in the first position and the valve 172 in the plunger 170 is open (e.g., after contacting the first actuator 174 and/or the lubricator 186), the plunger 170 may begin descending back to the bottom of the well 160. The compressed gas may continue to flow into the sales line 146 as the plunger 170 descends.

The method 300 may also include transmitting a second signal from the wellhead controller 180 to the compressor controller 150 a predetermined amount of time after the plunger 170 is determined to be at the predetermined position in the well 160, as at 310. The second signal may be transmitted through a cable or wire, or the second signal may be transmitted wirelessly. In another embodiment, the compressor controller 150 may have a timer set to the predetermined amount of time so that the second signal from the wellhead controller 180 may be omitted. The predetermined amount of time may be the time (or slightly more than the amount of time) that it takes for the plunger 170 to descend back to the bottom of the well 160 (e.g., to contact the second actuator 176), which may be known or estimated. For example, the density of the plunger 170, the density of the fluids in the well 160, and the distance between the first and second actuators 174, 176 may all be known or estimated. This may enable a user to calculate or estimate the time for the plunger 170 to descend to the bottom of the well 160.

In response to receiving the second signal, the compressor controller 150 may actuate the second valve 142 into the second position, as at 312. In another embodiment, the compressor controller 150 may automatically perform the actuation at 312 after the predetermined amount of time, and the second signal may be omitted.

When the second valve 142 is in the second position, the compressed gas may flow from the compressor 130, through the second valve 142, and into the annulus 166 in the well 160. A pressure of the gas flowing into the well 160 may be substantially equal to a pressure of the gas introduced into the sales line 146. The compressed gas may then flow down through the annulus 166 and into the tubing string 164 at a position below the plunger 170 and/or the second actuator 176. The compressed gas may then flow up through the tubing string 164, which may lift the plunger 170 back toward the surface. In another embodiment, an injection valve may be attached to the tubing string 164 at a location below the plunger 170 and/or the second actuator 176. The compressed gas may be injected through the injection valve and into the tubing string 164.

The compressed gas and/or the gas lifted by the plunger 170 may then flow through the valves 182, 184 and into the separator 190, as at 314. The gas may then exit the separator and flow back into the inlet 132 of the compressor 130, as at 316, to complete the loop. When the gas flowing out of the well 160 is introduced back into the compressor (via the separator 190), this allows the compressor to pull (e.g., suck) on the tubing string 164. This may exert a force inside the tubing string 164 that pulls the plunger 170 upward.

The plunger 170 may continue to ascend in the well 160 during 314, 316, or both. The method 300 may then cycle back to determining when the plunger 170 is at a predetermined position in the well 160, as at 304.

Figure 4:
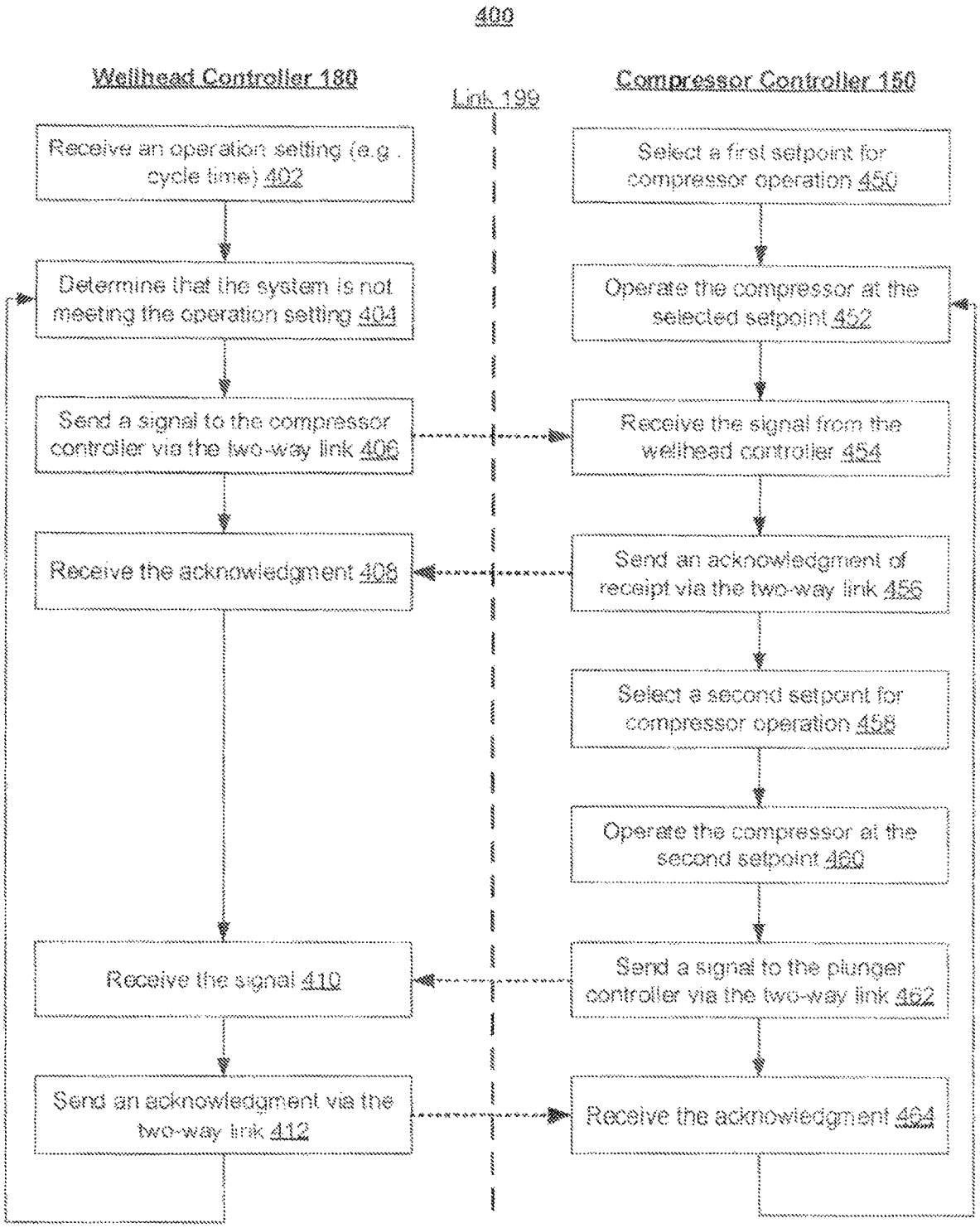
FIG. 4 illustrates a flowchart of a method for controlling a gas-lift system, according to an embodiment.

FIG. 4 illustrates a flowchart of a method 400 for controlling operation of the system 100, according to an embodiment. The method 400 may be conducted by operation of the wellhead controller 180 and the compressor controller 150 coupled together (i.e., paired) via the link 199. In some embodiments, however, a single controller may operate to perform both sides of the link 199, e.g., by communication with sensors positioned where the wellhead controller 180 and/or the compressor controller 150 are described. In some embodiments, the wellhead controller 180 and the compressor controller 150 may operate in a peer-to-peer configuration, but in others, one may be a master and may direct operation of the other controller, which acts as the slave. Various other configurations may be employed.

In the illustrated embodiment, the method 400 may begin on the wellhead controller 180 side with the wellhead controller 180 receiving an operation setting (e.g., cycle time), as at 402. Receiving at 402 may occur at initialization of the system 100, or may represent a change in the system 100 operation enforced by a user, e.g., after the system 100 has already been operating. Various operation settings may be employed instead of or in addition to cycle time, such as pressure settings in the case that pressure transducers are provided. In the illustrated embodiment, the wellhead controller 180 may thus be configured to track and record the duration of the cycle of plunger travel, and may compare the recorded duration (or other operation setting) with that received at 402. In some embodiments, this may be a direct comparison, e.g., of the most recent cycle or reading, or an average or other metric of the past several or more recordings.

Based on this comparison, the wellhead controller 180 may determine that the system 100 is not meeting the operation setting, as at 404. For example, the wellhead controller 180 may determine that the cycle time is too long (i.e., not enough lift gas). In response to such determination, the wellhead controller 180 may send a control signal to the compressor controller 150 via the two-way link 199, as at 406. The control signal may be a simple binary signal, e.g., a signal at a certain, predetermined frequency. In other embodiments, the control signal may be more complex, and may include data representing the present operating characteristics of the system (e.g., the present cycle time), the amount of change of injection gas flowrate, etc.

In some embodiments, the control signal may represent a command to the compressor controller 150. For example, the command may be to load and speed up the compressor 130, e.g., to preset RPM and suction settings. Another command may be to unload and slow down the compressor 130 to preset RPM and suction settings. Another command may be to increase the rate of compressor 130, which may be achieved by increasing the suction pressure, if available, and otherwise increasing the compressor speed. Another command may be to decrease the rate of compressor 130 by decreasing speed and/or suction pressure. Another command may be to divert some or all compressed gas to the casing anti/or to the sales line, which may result in modulation of the diverter and/or unloader valves 140, 142, and/or modulation of the speed and/or suction settings.

In the meantime, the compressor controller 150 may be controlling the operation of the compressor 130, thereby driving the system 100. For example, the compressor controller 150 may select a first setpoint for compressor 130 operation, as at 450. In some embodiments, the selection of the first setpoint may be received from a remote user, e.g., communicating with the compressor controller 150 via a model and/or the two-way link 199, as discussed above. The first setpoint may be established based on the conditions in which the system 100 operates, e.g., including the suction pressure, compressor speed (e.g., depending on the size and type of compressor), lift-gas requirements of the well, etc. The setpoint may include operating values for one or more characteristics. For example, the setpoint may include a speed of the compressor 130, a suction pressure, a diverter and/or unloader valve position and/or timing scheme, as discussed above. The setpoint may also include anything else relevant to the operation of the compressor 130 in the system 100. The compressor controller 150 may thus operate the compressor 130 (and any associated valves, e.g., at the inlet 132, the diverter valve 142, the unloader valve 140), as at 452.

As mentioned above, at some point, the wellhead controller 180 may send a control signal at 406, which the compressor controller 150 may receive, as at 454. The compressor controller 150 may send an acknowledgment of the receipt of the signal, as at 456, which may be received by the wellhead controller 180, as at 408. This may indicate to the wellhead controller 180 that the compressor controller 150 is online and operational.

In response to receiving the signal at 456, the compressor controller 150 may select a second setpoint for compressor operation, as at 458. In some embodiments, the compressor controller 150 may be loaded with one or more setpoints to select from, and may thus choose another setpoint (e.g., higher suction pressure, higher RPM, less diversion, etc.). In other embodiments, the control signal sent by the wellhead controller 180 to the compressor controller 150 at 406 may specify the new operating parameters for the compressor 130, and thus the compressor controller 150 may simply give effect to these commands (e.g., acting as a slave). In still other embodiments, the wellhead controller 180 may specify an amount of additional gas flowrate needed, and the compressor controller 150 may select one among several (potentially infinite) options for the operating the compressor 130 in order to achieve the desired flowrate.

The compressor controller 150 may then cause the compressor 130 to operate at the second setpoint, as at 460. This may be achieved by increasing compressor speed, opening a different pilot valve at the inlet 132 (as explained above), modulating the position of a variable—position inlet pilot valve (also mentioned above), modulating the position of the diverter and/or unloader valves 140, 142, or in any other suitable manner.

The operation at the second setpoint may be transitory, e.g., to temporarily increase the injection rate of gas into the well, and after a predetermined duration or another trigger, the compressor controller 150 may be configured to resume operation of the compressor 130 according to the first setpoint. In other situations, the operation at the second setpoint may be open-ended in time, and may continue until the wellhead controller 180 again indicates that the system is not meeting the operation setting.

The compressor controller 150 may, at some time, e.g., after adjusting the operation of the compressor 130 to operate at the second setpoint, send a signal to the wellhead controller 180 via the two-way link, as at 462. This signal, when received by the wellhead controller 180, as at 410, may indicate to the wellhead controller 180 that the compressor controller 150 is online and adjusted operation of the compressor 130, as requested. The wellhead controller 180 may respond with an acknowledgment signal, as at 412, which may be received by the compressor controller 150, as at 464. The wellhead controller 180 may then loop back to 404, and may continue determining whether the system is meeting the operation setting and perform the above-described sequence in the case that the system 100 is not operating at the operation setting. Similarly, the compressor controller 150 may loop back to 452, and may operate the compressor 130 at the selected setpoint (whether the first or second setpoint, or the first setpoint for a duration and then the second setpoint, etc.).

Accordingly, it will be seen that the system 100 is able to control the operation of the compressor 130, including load and unloading, in response to plunger 170 operation, via communication with the wellhead controller 180. Thus, the system 100 may be able to more quickly react to operating conditions changing, thereby reducing or eliminating the need to purchase gas to introduce to the compressor via suction makeup valves.

In a specific example of operation, the wellhead controller 180 may receive an operational setting (cycle time) of 15 minutes. The wellhead controller 180 may record a cycle time of 16 minutes. In response, the wellhead controller 180 may signal to the compressor controller 150 via the two-way link 199 that the well 160 should operate at a higher injection flowrate. The compressor controller 150, in response, may change the rate of injection by increasing the compressor RPM and/or suction pressure to the compressor 130, or, for machines that inject and sell, by reducing the amount of gas that is being sent to the sales line and diverting it to the casing for injection. The compressor then sends the wellhead controller 180 a confirmation (acknowledgment) signal using the two-way link 199.

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A method for controlling operation of a well, comprising:

introducing a gas into a pressure vessel;

transmitting the gas into a compressor and compressing the gas;

assessing when a plunger in the well is at a first predetermined position in the well;

generating a signal from a wellhead controller when the plunger is assessed to be at the first predetermined position in the well;

transmitting the signal from the wellhead controller to a compressor controller;

receiving the signal at the compressor controller;

based at least in part upon receiving the signal at the compressor controller, changing the speed or suction pressure of the compressor;

descending the plunger into the well;

assessing when the plunger reaches a second predetermined position in the well;

generating a second signal from the wellhead controller after the plunger is assessed to have reached the second predetermined position in the well;

transmitting the second signal from the wellhead controller to the compressor controller;

receiving the second signal at the compressor controller;

based at least in part upon receiving the second signal at the compressor controller, changing the speed or suction pressure of the compressor and injecting the gas compressed by the compressor into the well; and lifting the plunger from the second predetermined position in the well to the first predetermined position in the well with the aid of the gas compressed by the compressor and injected into the well.

2. The method according to claim 1, wherein the gas is a mixture of natural gases.

3. The method according to claim 1, wherein the gas is introduced into the pressure vessel through a first inlet.

4. The method according to claim 1, further comprising: removing particles from the gas in the pressure vessel.

5. The method according to claim 1, wherein the first predetermined position in the well is at a highest elevation of a plunger within the well.

6. The method according to claim 1, wherein the first predetermined position in the well is the plunger contacting a first actuator.

7. The method according to claim 1, wherein the first predetermined position in the well is the plunger contacting a lubricator.

8. The method according to claim 1, wherein the transmitting the signal is through one of wirelessly or through a wire.

9. The method according to claim 1, wherein the assessing when the plunger in the well is at the first predetermined position in the well is through use of a sensor.

10. The method according to claim 9, wherein the sensor is pressure transducer.

11. The method according to claim 1, wherein the compressed gas exits the compressor and enters an annulus of the well.

12. A method for controlling operation of a well, comprising:

introducing a gas into a pressure vessel;

transmitting the gas into a compressor and compressing the gas;

determining when a plunger in the well is at a first predetermined position in the well;

generating a signal from a wellhead controller when the plunger is at the first predetermined position in the well;

transmitting the signal from the wellhead controller to a compressor controller;

receiving the signal at the compressor controller;

based at least in part upon receiving the signal at the compressor controller, changing the speed or suction pressure of the compressor;

descending the plunger into the well;

waiting a predetermined amount of time and changing the speed or suction pressure of the compressor and injecting the gas compressed by the compressor into the well; and lifting the plunger from the second predetermined position in the well to the first predetermined position in the well with the aid of the gas compressed by the compressor and injected into the well.

13. The method according to claim 12, wherein the predetermined amount of time is determined by the compressor controller.

14. The method according to claim 12, wherein the compressed gas exits the compressor and enters an annulus of the well.

15. A method for controlling operation of a well, comprising:

introducing a gas into a pressure vessel;

transmitting the gas into a compressor;

operating the compressor with a compressor controller at a first setpoint;

receiving an operation setting at a wellhead controller;

comparing the operation setting at the wellhead controller with a recorded operation setting by the wellhead controller;

sending a control signal to the compressor controller from the wellhead controller;

receiving the control signal at the compressor controller, wherein the control signal contains a second setpoint; and altering the compressor to run at the second setpoint, wherein the sending of the control signal to the compressor controller is performed when the operation setting and the recorded operation setting do not agree.

16. A method for controlling operation of a well, comprising:

receiving gas at an inlet of a compressor;

controlling the compressor with a compressor controller;

injecting gas compressed by the compressor into the well to assist lifting a plunger in the well;

using a wellhead controller to assess one or more well conditions or plunger lift parameters; and sending a signal from the wellhead controller to the compressor controller to alter operation of the compressor based on the one or more well conditions or parameters assessed by the wellhead controller, wherein the altered operation of the compressor is its speed or suction pressure, and wherein one of the well conditions or plunger lift parameters is based on actual or perceived location of a plunger or plunger cycle time.

17. The method of claim 16 further comprising:

delivering compressed gas from the compressor to a diverter valve;

controlling the diverter valve with the compressor controller such that the compressed gas is diverted to the well or to a purchase line.

18. The method of claim 17 wherein the gas received at the inlet of the compressor is received from the well or an output of a pressure vessel, whereas in the case in which the gas is received from an output of a pressure vessel, the pressure vessel includes a gas input from the compressor and a gas input from the well.

19. The method of claim 18 wherein the compressor pulls on the well so as to pull the plunger toward the top of the well and evacuate gas from the well.

20. The method of claim 19 wherein gas is injected or not injected into the well during specific periods, including that gas is not injected into the well during periods when the plunger is determined to be at the top of the well and that gas is injected into the well during periods when the plunger is determined to be at the bottom of the well.

21. The method of claim 20 wherein gas is diverted to the sales line during periods that the plunger is determined to be at the top of the well.

22. The method of claim 18 wherein the wellhead controller and the compressor controller are the same controller.

* * * * *